United States Patent [19]

Chesebro, Jr. et al.

[11] Patent Number: 4,571,959

[45] Date of Patent: Feb. 25, 1986

[54] KNIT CAP WITH INTEGRALLY KNIT EARFLAPS

[75] Inventors: Robert E. Chesebro, Jr.; Philip C. Aigner, both of Sheboygan, Wis.

[73] Assignee: Wigwam Mills, Inc., Sheboygan, Wis.

[21] Appl. No.: 741,962

[22] Filed: Jun. 6, 1985

[51] Int. Cl.[4] ..... D04B 1/00

[52] U.S. Cl. ..... 66/169 R; 2/201; 2/195

[58] Field of Search ..... 66/169, 170, 202; 2/201, 195, 198

[56] References Cited

U.S. PATENT DOCUMENTS

| | | | |
|---|---|---|---|
| 1,787,043 | 12/1930 | Karger | 2/201 |
| 2,199,473 | 5/1940 | Wengen | 2/201 |
| 2,259,537 | 10/1941 | Wengen | 2/201 |
| 2,294,529 | 9/1942 | Wengen | 2/201 |
| 3,246,340 | 4/1966 | Bonk et al. | 2/201 |

*Primary Examiner*—Ronald Feldbaum

*Attorney, Agent, or Firm*—Bell, Seltzer, Park & Gibson

[57] ABSTRACT

The integrally knit earflaps are fashioned during the knitting operation and extend downwardly below the opposite side portions of the lower edge of the upper band of the cap. The crown of the cap is formed of single-ply fabric while the lower band, earflaps and selvage band are knit of two-ply fabric. The inner ply of the lower band and the earflaps are knit of a hydrophobic yarn while the remainder of the cap is knit of a hydrophilic yarn to aid in wicking moisture from the forehead and ears of the wearer.

18 Claims, 4 Drawing Figures

KNIT CAP WITH INTEGRALLY KNIT EARFLAPS

FIELD OF THE INVENTION

This invention relates generally to a knit cap, and more particularly to such a cap including fashioned earflaps integrally knit with and extending downwardly on opposite side portions of the cap.

BACKGROUND OF THE INVENTION

It is generally known to manufacture knit caps with earflaps, as disclosed in U.S. Pat. Nos. 2,199,473, 2,959,537, and 2,294,529, issued to F. J. Wengen, and U.S. Pat. No. 1,957,206, issued to A. Goldstein. The Wengen '529 and '473 patents each discloses forming a knit cap of a seamless tubular blank by closing one end of the tubular blank to form the crown of the cap and then cutting and sewing the lower edge of the tubular fabric to form integral earflaps. However, the cutting and sewing of the lower edge of the tubular blank adds considerable cost to the production of such caps.

The cap of the Wengen '537 patent is formed from a pair of flat knit strips which are joined together along a curved seam line to form the crown and the earflaps are formed by cutting and sewing the lower edge portion of the cap. The cap of the Goldstein patent is formed by a plurality of interknit triangular panels to provide the crown and a separately knit band, provided with earflaps, is attached to the lower edge of the crown of the cap by a sewing operation. The cutting and sewing operation associated with the manufacture of these prior art types of caps also increases the cost of producing the same.

SUMMARY OF THE INVENTION

With the foregoing in mind, it is an object of the present invention to provide a knit cap with integrally knit earflaps in which the earflaps are formed during the knitted operation and are fashioned by successively knitting adjacent partial courses of gradually increasing length to thereby eliminate any cutting and sewing of the lower edge portion of the cap during the finishing operation.

The knit cap of the present invention includes an upper closed crown portion with a lower band integrally knit with the lower edge of the crown so that the lower band extends around the head and above the ears and across the forehead of the wearer. The earflaps are integrally knit with and extend downwardly from opposite side portions of the lower edge of the lower band and a selvage band is integrally knit with the lower edge portion of the lower band and the earflaps and extends around the lower open end of the cap.

It is preferred that the selvage band, the earflaps, and the lower band each includes separate inner and outer plies of fabric. The inner plies of the lower band and the earflaps are knit of a hydrophobic yarn while the outer plies of the lower band and the earflaps are knit of a hydrophilic yarn to aid in wicking perspiration and moisture from the head and ears of the wearer to the outer plies. The crown portion of the cap is preferably knit of a single ply fabric and may be knit with yarns of different colors to form a distinctive pattern in the crown.

The cap of the present invention is preferably formed from a substantially rectangular blank which is preferably knit on a V-bed type knitting machine with the integrally knit earflaps being fashioned and formed in spaced-apart relationship along the lower edge of the rectangular blank. The cap is then formed from the knit blank by simply sewing together opposite end edge portions and forming sewn gussets in the upper end to close the crown portion.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 4:
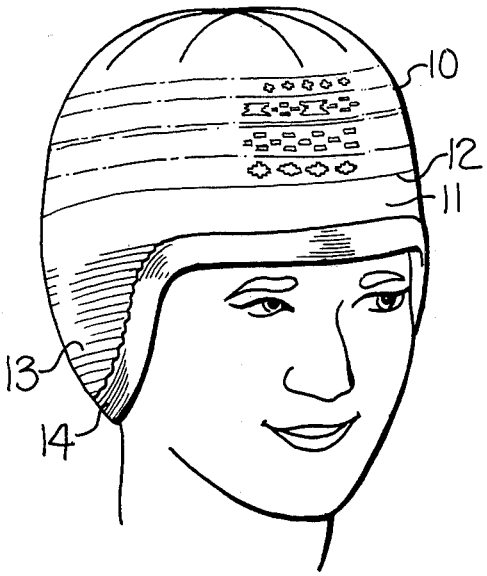
FIG. 4 is a front perspective view of the cap of the present invention in position on the head of a wearer.
Figure 3:
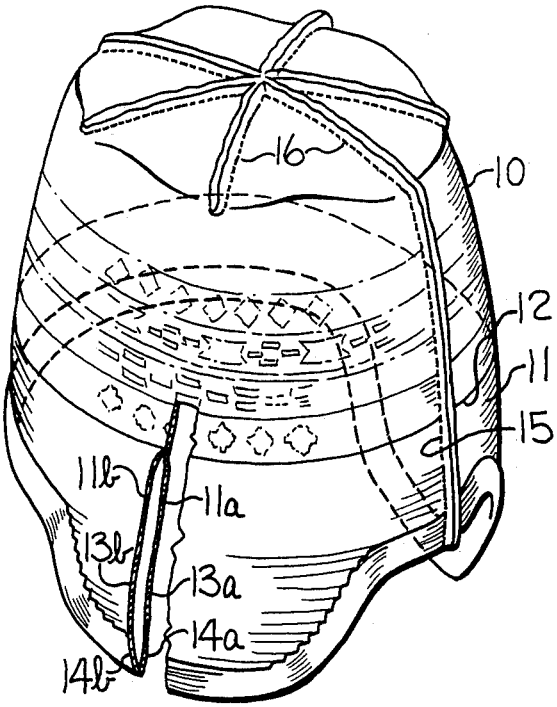
FIG. 3 is a side perspective view of the cap of the present invention in wrong-side-out condition, illustrating the manner in which opposite end portions of the blank of FIG. 1 are sewn together, and the manner in which the gussets are formed in the closed crown of the cap.

The knit cap of the present invention, as illustrated in FIGS. 3 and 4, includes an upper closed crown portion 10 and a lower band 11 integrally knit with the lower edge, indicated by the line 12, of the crown portion 10. The lower band 11 is adapted to extend around the head and above the ears and across the forehead of the wearer, as illustrated in FIG. 4. Earflaps 13 are integrally knit with and fashioned to extend downwardly below opposite side portions of the lower edge portion of the lower band 11 and a selvage band 14 is integrally knit with the lower edge portion of the lower band 11 and the earflaps 13 and extends around the lower open end of the cap.

The crown 10, lower band 11, and selvage band 14 each includes successive complete courses, as indicated by the shade lines, of stitch loops extending around the cap and defining adjacent wales extending throughout the length of the cap. The earflaps 13 each includes successive partial courses, as indicated by the shade lines thereon, which gradually increase in length from the selvage band 12 to the lower band 11.

Figure 2:
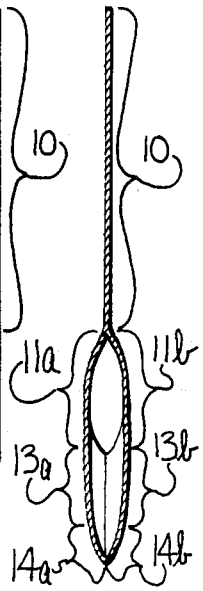
FIG. 2 is a somewhat schematic vertical sectional view taken substantially along the line 2—2 in FIG. 1.

As illustrated in FIG. 3, a seam 15 extends upwardly from the lower edge portion of the selvage band 14 and connects together the opposite ends of the complete courses of the crown 10, the lower band 11, and the selvage band 14. Inwardly converging seams 16 are formed in the upper portion of the crown to form joined together gussets closing the upper end of the crown 10. As illustrated in FIGS. 2 and 3, the crown portion 10 includes a single ply of fabric while the lower band 11 includes respective outer and inner plies **11*a*, 11*b*, the earflaps 13 include respective outer and inner plies 13*a*, and 13*b*, and the selvage band 14 includes respective outer and inner plies 14*a*, 14*b*. A single make-up course, not shown, integrally joins the lower adjacent edges of the outer and inner plies 14*a*, and 14*b* of the selvage band 14**.

It is preferred that the single ply of the crown 10, the outer ply **11*a* of the lower band 11, the outer plies 13*a* of the earflaps 13, and both the inner and outer plies 14*a*, 14*b* of the selvage band 14 be knit of a hydrophilic type of yarn and that the inner ply 11*b* of the lower band 11** and the inner plies 13*b* of the earflaps 13 be knit of a hydrophobic type of yarn. The hydrophilic yarn is preferably a natural yarn, such as wool, and the hydrophobic yarn is a synthetic yarn, such as polypropylene. Since the inner portion of the cap which engages the forehead and ears of the wearer is formed of the hydrophobic yarn, perspiration and moisture are wicked by this hydrophobic yarn to the hydrophilic yarn on the outside of the cap so that any such moisture is readily evaporated. Also, the portions of the cap which engage the forehead and ears of the wearer do not contain yarn which is allergenic to some wearers, as is wool, so that the polypropylene inner layers or plies do not irritate the wearer.

The blank of FIG. 1 will be described as being knit on V-bed machines often referred to as an automatic jacquard double system flat knitting machine with stitch transfer capability. However, it is to be understood that the present cap can also be knit on other conventional types of knitting machines.

Figure 1:
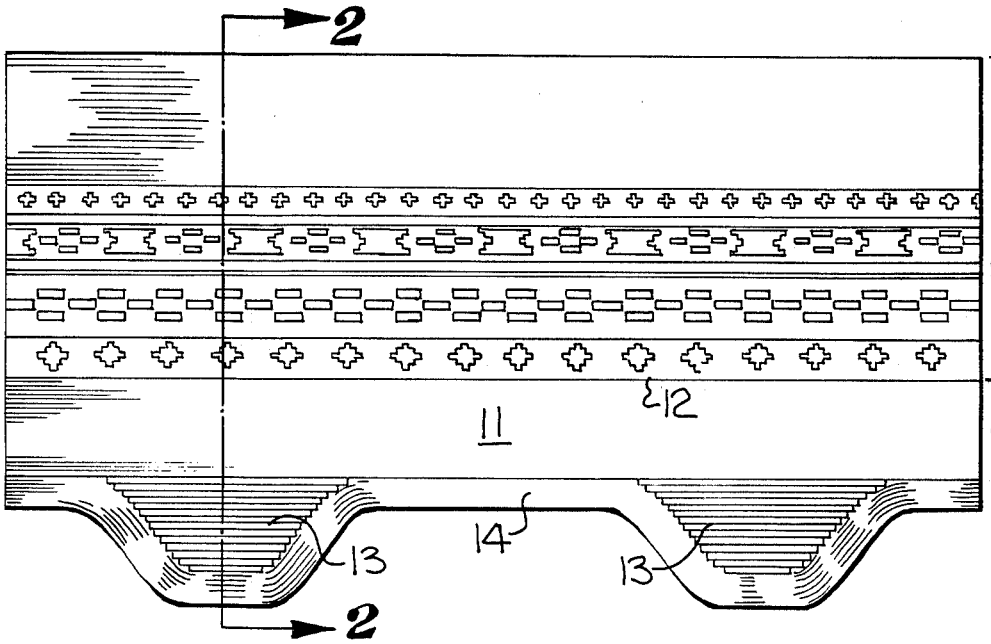
FIG. 1 is a plan view of the knit blank for forming the cap of the present invention.

The blank of FIG. 1 is knit from the bottom to the top and is started by feeding yarn to alternate needles in the front and rear needle beds to form a single make-up course. Knitting continues by knitting approximately six courses of the wool yarn on all of the needles in the front and rear needle beds to form the outer and inner plies 14*a*, 14*b* of the selvage band 14. The wool yarn is then withdrawn and the polypropylene yarn is fed to and knit on spaced-apart groups of adjacent needles in the front needle bed, for example, 12 adjacent needles, while the wool yarn is fed to and knit on corresponding needles in the rear needle bed. The number of needles knitting in the spaced-apart groups of needles in the front and rear needle beds is gradually increased as the partial courses are knit so that successive partial courses gradually increase in length from the selvage band 14 to the lower band 11. For example, it has been found that satisfactory fashioned earflaps 13 can be formed by knitting approximately 34 partial courses with gradual widening until 46 needles are knitting in each of the spaced apart groups in the front and rear needle beds. Thus, the polypropylene yarn forms the partial courses in the inner ply 13*b* while the wool yarn forms the successive partial courses in the outer ply 13*a* of the spaced-apart earflaps 13.

Upon completion of the knitting of the earflaps 13, the wool and polypropylene yarns continue to be fed to and knit on all of the needles of the respective front and rear needle beds to knit full courses in the respective outer and inner plies 11*a*, 11*b* of the lower band 11. The outer and inner plies 11*a*, 11*b* of the lower band 11 each includes approximately 24 courses. The single-ply fabric of the crown 10 is then knit and it is preferred that wool yarns of different colors be selectively fed to and knit on needles in both the front and rear needle beds to form distinctive and decorative pattern bands, of the type illustrated in FIG. 1, around the lower portion of the crown 10.

The upper portion of the crown 10 is then formed by knitting a one-by-one rib single-ply fabric. The rib fabris is knit by feeding and knitting the wool yarn on alternate needles in the front and rear needle beds. It is preferred that approximately 32 courses be knit in the decorative bands and that approximately 26 courses be knit in the formation of the ribbed upper portion of the crown 10.

After the knitting of the blank is completed, as illustrated in FIG. 1, the cap is formed by simply sewing together opposite end portions of the blank by means of the seam line 15. The upper end of the crown 10 is then gathered together and the stitch lines 16 are formed in inwardly converging relationship to form the gusseted closed end thereof. Thus, the fashioned earflaps 13 are formed and the lower edge of the cap is finished during the knitting operation so that no cutting and sewing operation is required around the lower edge of the cap.

In the drawings and specification there has been set forth the best mode presently contemplated for the practice of the present invention, and although specific terms are employed, they are used in a generic and descriptive sense only, and not for purposes of limitation, the scope of the invention being defined in the claims.

That which is claimed is:

1. A knit cap including an upper closed crown portion, a lower band integrally knit with the lower edge portion of said crown, said lower band adapted to extend around the head and above the ears and across the forehead of the wearer, fashioned earflaps integrally knit with and extending downwardly below opposite side portions of the lower edge portion of said lower band, and a selvage band integrally knit with the lower edge portion of said lower band and said earflaps and extending around the lower open end of said cap, wherein said crown, said lower band, and said selvage band each comprises successive complete courses of stitch loops extending around said cap and defining adjacent wales extending throughout the length of said cap, said earflaps each comprising successive partial courses gradually increasing in length from said selvage band to said lower band.

2. A knit cap according to claim 1 wherein said successive complete courses include opposed opposite ends, and including seam means extending from the lower edge portion of said selvage band to the closed upper end of said crown portion, said seam means connecting together the opposite ends of said complete courses of said crown, said lower band, and said selvage band.

3. A knit cap according to claim 1 wherein said selvage band, said earflaps, and said lower band each comprises separate inner and outer plies of fabric.

4. A knit cap according to claim 3 wherein the lower edge portion of said selvage band includes a single make-up course integrally joining said inner and outer plies of said selvage band.

5. A knit cap according to claim 3 wherein said outer plies of said lower band, and said earflaps, are knit of one type of yarn, and wherein said inner plies of said lower band and said earflaps are knit of a second type of yarn.

6. A knit cap according to claim 5 wherein said one type of yarn is wool, and wherein said second type of yarn is a synthetic yarn.

7. A knit cap according to claim 6 wherein said synthetic yarn is polypropylene.

8. A knit cap according to claim 3 wherein said inner and outer plies of said selvage band each comprise approximately six courses.

9. A knit cap according to claim 8 wherein each ply of each of said earflaps comprises approximately 34 partial courses.

10. A knit cap according to claim 9 wherein each of said inner and outer plies of said lower band comprises approximately 24 courses.

11. A knit cap according to claim 10 wherein said crown comprises single ply fabric.

12. A knit cap according to claim 3 wherein at least a portion of said single ply knit crown is knit of at least two colors of yarn forming a decorative pattern in said crown.

13. A knit cap includingg a single-ply upper closed crown portion, a two-ply lower band integrally knit with the lower edge portion of said crown, said lower band adapted to extend around the head and above the ears and across the forehead of the wearer, two-ply earflaps integrally knit with and extending downwardly below opposite side portions of the lower edge portion of said lower band, a selvage band integrally knit with the lower edge portion of said lower band and said earflaps and extending around the lower open end of said cap, wherein said crown, said lower band, and said selvage band each comprises successive complete courses of stitch loops extending around said cap and defining adjacent wales extending throughout the length of said cap, said successive complete courses including opposed opposite ends, said earflaps each comprising successive partial courses gradually increasing in length from said selvage band to said lower band, and seam means extending from the lower edge portion of said selvage band to the closed upper end of said crown portion, said seam means connecting together the opposite ends of said complete courses of said crown, said lower band, and said selvage band.

14. A knit cap according to claim 13 wherein the outer plies of said lower band and said earflaps are knit of hydrophilic yarn, and wherein the inner plies of said lower band and said earflaps are knit of hydrophobic yarn.

15. A knit cap including an upper closed crown portion, a lower band integrally knit with the lower edge portion of said crown, said lower band adapted to extend around the head and above the ears and across the forehead of the wearer, and fashioned earflaps integrally knit with and extending downwardly below opposite side portions of the lower edge portion of said lower band, wherein said crown and said lower band each comprises successive complete courses of stitch loops extending around said cap and defining adjacent wales extending throughout the length of said cap, and wherein said crown is knit of hydrophilic yarn and said lower band and said earflaps are knit of hydrophobic yarn.

16. A knit cap according to claim 15 wherein said hydrophilic yarn is wool, and wherein said hydrophobic yarn is polypropylene.

17. A knit cap according to claim 16 wherein said earflaps each comprises successive partial courses gradually increasing in length toward said lower band.

18. A knit cap according to claim 17 including a selvage band integrally knit with the lower edge of said lower band and said earflaps and extending around the lower open end of said cap.

* * * * *